US008282457B1

(12) United States Patent
Edwards

(10) Patent No.: US 8,282,457 B1
(45) Date of Patent: Oct. 9, 2012

(54) ELECTRONIC TABLE GAME

(76) Inventor: Brandon Edwards, Johnstown, NY (US)

( * ) Notice: Subject to any disclaimer, the term of this patent is extended or adjusted under 35 U.S.C. 154(b) by 131 days.

(21) Appl. No.: 12/955,107

(22) Filed: Nov. 29, 2010

Related U.S. Application Data

(60) Provisional application No. 61/283,057, filed on Nov. 27, 2009.

(51) Int. Cl.
*A63F 9/24* (2006.01)
*A63F 9/02* (2006.01)
*A63B 67/00* (2006.01)

(52) U.S. Cl. ..... 463/7; 273/309; 273/342

(58) Field of Classification Search ..... 273/309, 273/342, 400–402, 440; 463/1, 7, 25; 473/476
See application file for complete search history.

(56) References Cited

U.S. PATENT DOCUMENTS 6,439,570 B2 * 8/2002 Rossi et al. ..... 273/108.1
8,146,921 B2 * 4/2012 Lombardi ..... 273/342
2004/0188942 A1 * 9/2004 Trokan ..... 273/342
2006/0027971 A1 * 2/2006 Radhakrishnan ..... 273/309
2010/0244384 A1 * 9/2010 Hoffer ..... 273/342
2012/0013073 A1 * 1/2012 Wyland ..... 273/287

* cited by examiner

*Primary Examiner* — David L Lewis
*Assistant Examiner* — Robert Mosser
(74) *Attorney, Agent, or Firm* — The Patent Practice of Szmanda & Shelnut, LLC; Charles R. Szmanda; James G. Shelnut

(57) ABSTRACT

Provided is an electronic game table which has one or more cup stations which contain one or more cups or other containers into which a game ball is meant to be thrown or bounced. The cups are connected to means of extending them through the table. The cups are also connected to means for retracting them below the table when a game ball has entered the cup. Also provided are means for returning the game ball to a designated area when the cup and ball have been retracted. The electronic game table is provided with electronic devices to direct various actions of the table and during game play. The table can be in provided in a plethora of geometric shapes.

18 Claims, 4 Drawing Sheets

ELECTRONIC TABLE GAME

REFERENCE TO PRIOR FILED APPLICATION

This application claims the benefit of U.S. Provisional Application No. 61/283,057 filed Nov. 27, 2009 under 35 U.S.C. §119(e).

FIELD OF THE INVENTION

The present invention relates to the technical field of electronics games. More particularly, the present invention relates to the field of electronic gaming machines. More particularly, the present invention is in the field of arcade style electronic gaming tables.

BACKGROUND TO THE INVENTION

Beer Pong without paddles (which in some regions is called Beirut) is a drinking game in which players throw a ping-pong ball across a table with the intent of landing the ball in one of the cups of beer on other side of table. There are no official rules, so rules may vary widely. Generally there are six or ten plastic cups arranged in a triangle on each side of an elongated table. The number of players on each team can vary as well, from one or more. In one set of rules, the game is won by eliminating all the other team's cups before all of one's own cups are eliminated. Existing requirements conventionally are limited to cups containing liquid (generally alcohol), ping-pong balls, and a planar surface with game play handled manually.

BRIEF SUMMARY OF THE INVENTION

The present invention provides for an arcade style electronic game table. In one example, the game table is approximately 6 ft. long or longer, 2.5 ft. wide (5 ft. wide if two are combined), and at least to inches in height. The table dimensions can be of different sizes and shapes and two or more tables may be combined. The table-top could also be constructed with varying cabinet and display designs. The general electronic configuration of the gaming table includes, for example, one or more input devices, a CPU, a memory device which would have random access memory (RAM) as well as read only memory (ROM), one or more side display devices, such device include for example "signing up" and other game information; table top displays including for example, a scoreboard; a sound card & speakers, sensors that transmit information to the CPU with electrical wires & circuits, such information including, for example, scoring and sounds, and one or more drive systems for presenting and retracting cups or other objects and other actions.

The table can have two separate opponent ends. Each end has an array of 6 or more cups in pyramidal or other geometric formation. Table tennis balls or "pong" balls or other suitable game balls are used by each team, with the object being to throw, or bounce, the game balls across the table into the opposing team's cups or other containers. Below the cups or other containers there is a cutout in the table top which may be a fraction larger than the shape of the pyramid or other geometric formation or outer perimeter of each cup or other container and into which the cups or other containers are positioned. When a game ball is thrown or bounced and it lands inside a cup or other container the game ball triggers a sensor attached to the cup or other container sending a signal to the CPU and causing CPU to send a signal to the drive system to mechanically lower the cup or other container beneath the table and thus removing that particular cup or other container from play (indicating a made shot). When the cup has been removed from play, electronic sensors signal for the cutout in the table top to be covered mechanically from underneath the table. Once the game ball activates the sensor it falls to a chute using a return track to a discharge opening at the end of the table.

One of the table top's exemplary embodiments comprise one or more input buttons, including for example, a start button, which, when activated sends a signal which raises the cups or other container through the cutouts in the table top to their pyramidal or other geometric formation wherein the game begins. Other exemplary input buttons may include a fault input button which is activated if a shot or any other action is requested to be cancelled. Other exemplary input buttons include for example an "our shot" button which is activated after an opponent has thrown or bounced two game balls. This button may be needed as there are no other detection/sensors for missed shots. Game play and the invention are described in further detail below. The solution of the present invention may evolve in the future. The present invention's main objective solution is to create an electronic landscape.

Therefore, according to a further exemplary embodiment, there is provided an electronic game table, comprising: a table top; a controlling computer; one or more cup stations attached to a vertical drive system; one or more cups at each cup station, wherein each cup comprises a sensor for sensing when a game ball enters the cup, wherein each sensor is connected to the controlling computer and wherein each cup station comprises means, responsive to the controlling computer, for extending and/or retracting each of the one or more cups, and means, connected to the controlling computer, for covering the holes after a cup is retracted, and means, connected to the controlling computer, for actuating one or more game functions.

According to a further exemplary embodiment, there is provided an electronic game table comprising: a table top; a controlling computer; one or more cup stations, wherein each cup station comprises one or more cups, wherein each cup station comprises a sensor for sensing a made shot, wherein each sensor is connected to the controlling computer and wherein each mounting base comprises; a vertical drive system, interfaced to the controlling computer, for extending each of said one or more cups; a vertical drive system, interfaced to the controlling computer and responsive to a made shot, for retracting each of said one or more cups; a mechanically operated cover, interfaced to the controlling computer, for covering the holes after a cup is retracted; and one or more buttons interfaced to the controlling computer for actuating game function, wherein the vertical drive systems for extending each of said one or more cups and for retracting each of said one or more cups can be the same or different and comprise a drive motor and gear drive combination, or a pneumatic drive.

According to a further exemplary embodiment, there is provided an electronic game table, comprising: a table top; a controlling computer; one or more playing stations, each playing station comprising a throwing end and a target end, on the opposite side of the table, wherein each target end comprises; one or more cup stations, wherein each cup station mounts one or more cups, each cup comprising a sensor for sensing a made shot, wherein each sensor is connected to the controlling computer and wherein each mounting base comprises means, responsive to the controlling computer, for extending each of said one or more cups; means, connected to the controlling computer and responsive to a made shot, for retracting each of said one or more cups; means, connected to the controlling computer for automatically racking cups at the beginning of play; means, connected to the controlling computer, for automatically re-racking the cups during play; means connected to the controlling computer for covering the holes after a cup is retracted; and one or more means connected to the controlling computer for actuating game function.

DETAILED DESCRIPTION

As used herein the term "cup" refers to a cup or other container which allows a game ball to enter and be contained with the cup or other container.

As used herein the term "game ball" refers to any ball suitable to be thrown, bounced or otherwise extended toward one side of the game table.

As used herein the term "geometric formation" refers to any arrangement of cups or containers, including, for example, pyramid, diamond, square, rectangular, or other arrangement chosen to enhance game interest.

As used herein, the term "cup station" refers to the device which holds a cup in place and protrudes and/or retracts the cup above and/or below the game table.

As used herein, the conjunction "or" is not intended to be exclusive unless otherwise stated.

Figure 1:
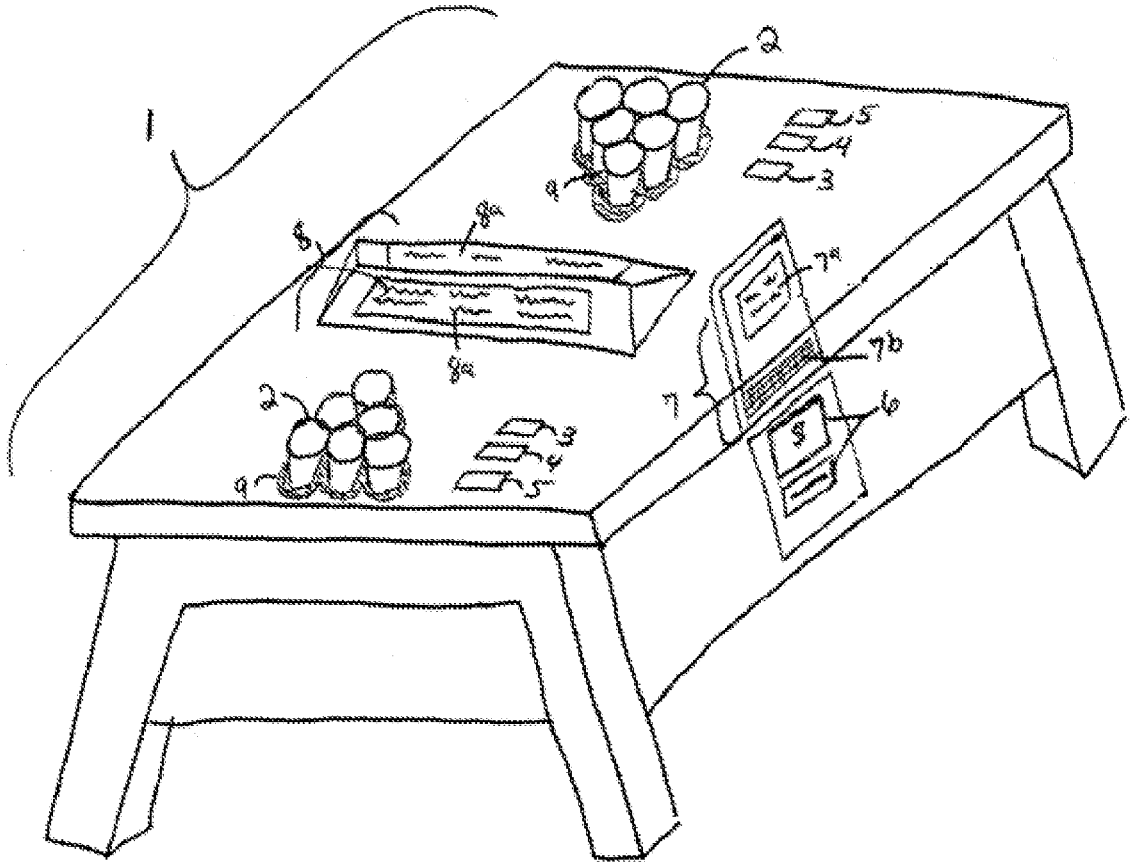
FIG. 1 is an elevated perspective view of the exterior of the game table according to an exemplary embodiment of the present invention.
Figure 4:
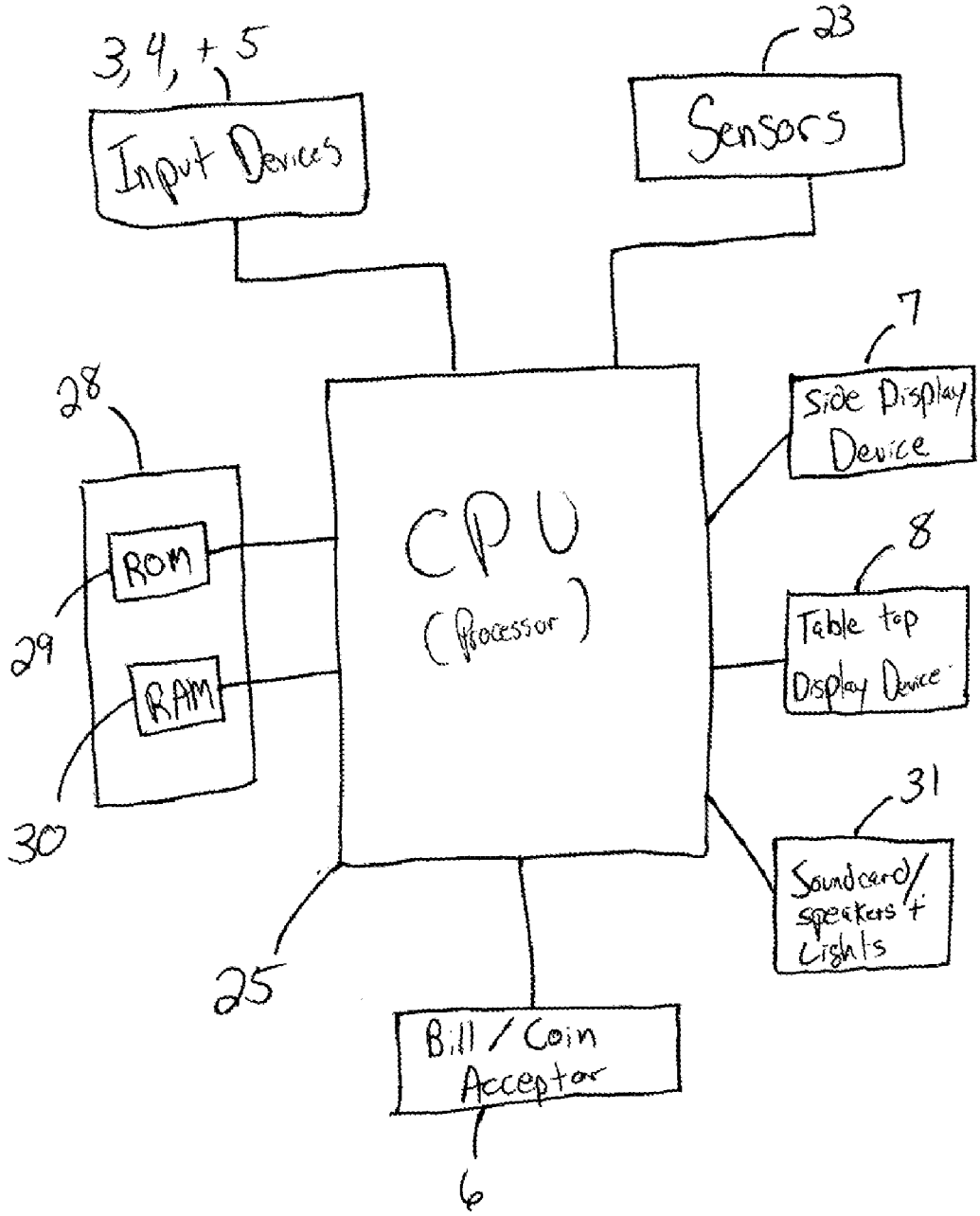
FIG. 4 is a schematic diagram of an electronic configuration of one exemplary embodiment of the game table of the present invention

Referring now to the drawings, one example of the electronic table game of the present invention is illustrated in FIG. 1 as electronic game table 1, showing an elevated perspective view of the game table and its various components. The electronic game table 1 has controls, displays, and features of an arcade style game. The electronic game table 1 can have mechanical, electronic, and video features. As illustrated in FIG. 1, cups or other containers 2 are positioned on opposite ends of the table in cutout holes 9. The input devices can be buttons labeled numerals 3,4, and 5. The CPU 25, shown in FIG. 4, is programmed to process the data received from the input devices 3, 4, and 5. For example, input device 3 can be designated for starting a game, and when pushed the cups 2 protrude through cutouts in the top of the table to provide (in this example) a pyramid formation and the game begins. Further, in the present example, device 4 is designated for cancelling any actions during game play. Further, in this example, input device 5 is designated to be pushed following an opponent taking two shots. Input device 5 signals the CPU 25 to activate the sensors attached to the cups or other containers at one end of the table while deactivating the sensors attached to the cups or other containers at the opposite end of the game table. Optionally, payment is accepted using means for accepting payment, 6. Such means for accepting payment can accept and identify bills, coins, credit cards, RFID tags, debit cards, tokens or equivalents thereof or combinations thereof. Accordingly, means for accepting payment can be coin changers and bill readers, such as might be found in standard vending machines, credit and debit card readers, which may be connected to a computer network, such as the Internet, RFID readers, which may be connected to a computer network such as the Internet, changers configured to accept tokens or equivalents thereof or combinations thereof. When a player inserts payment into the payment acceptor 6, credit is acknowledged and game and or sign up instructions are given on display screen 7*a* of side display device 7. To enter commands or sign up the side display device 7 is equipped with a keyboard 7*b*. During game play the table top display device 8 will display to the players on each side any information concerning the game on the display screens 8*a*.

Figure 2:
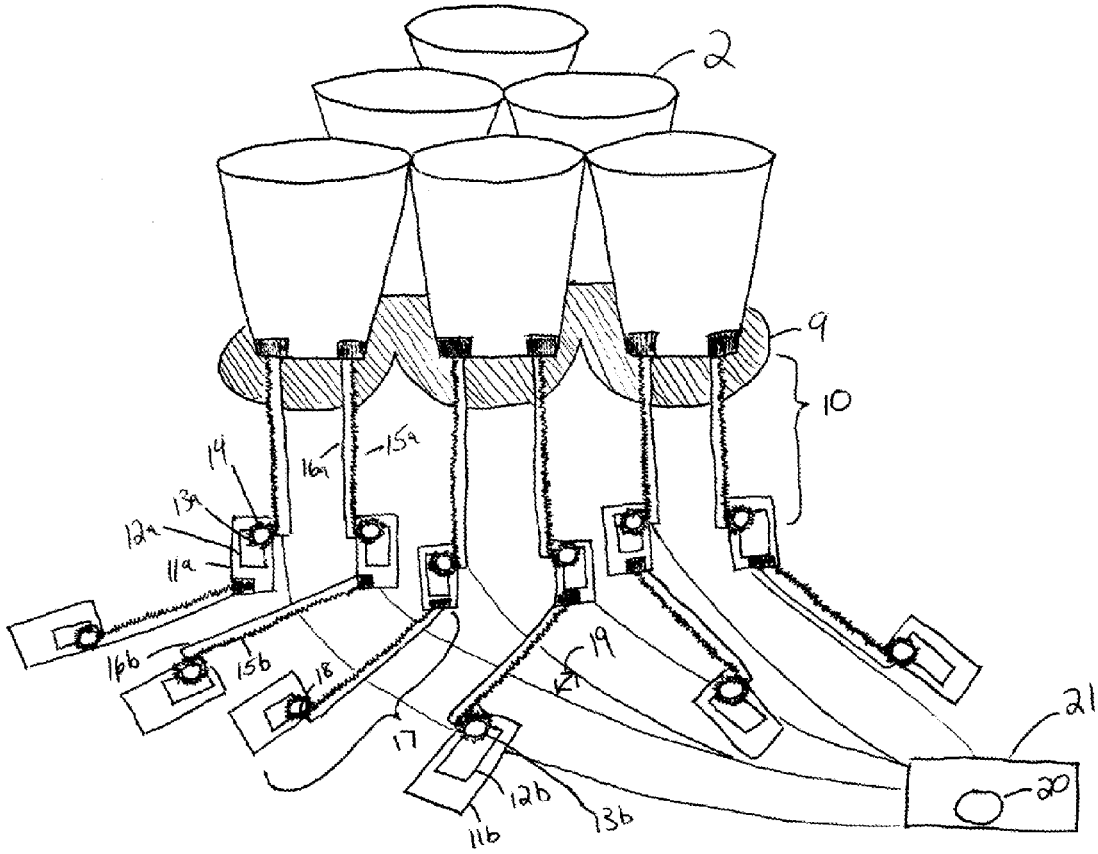
FIG. 2 is partially cut-away view illustrating a protruding/retreating drive system of the invention.

In FIG. 2, cups 2 protrude and retreat through cut out holes 9 using a vertical drive system 10. Reference numeral 11*a* indicates the housing mechanical base that is mounted inside the machine. Fastened to the housing mechanical base 11*a* a motor 12*a* drives a motor gear 13*a* that in turns rotates the vertical drive gear 14. The vertical drive gear engages a plurality of teeth 15*a* causing the retreat of the advancing/retracting member 16*a*. The advancing/retracting members 16 are affixed to the cups 2 allowing successful retreat of the cups 2. The cups 2 in motion or in stationary position are always supported by the housing mechanical base 11*a*. Some cups 2 need to include a horizontal drive system 17 due to the reformations needed in game play. The horizontal drive system 17 is used in conjunction with the vertical drive system 10. Once the vertical drive system 10 has fully retreated a cup 2 and removed it from play, the entire housing mechanical base 11*a* and all affixed components including cup 2 will be retreated horizontally. Fastened to another mechanical base 11*b* motor 12*b* drives a motor gear 13*b* that in turn rotates the horizontal drive gear 18. The horizontal drive gear 18 engages a plurality of teeth 15*b* of the advancing/retracting member 16*b* that is affixed to the housing mechanical base 11*a*. When the cups 2 are protruded back to start position using the same horizontal drive system 17 and vertical drive system 10. Positioned below each housing mechanical base 11*a* are chutes 19 that give the game ball 20 a return track to a discharge opening 21 at the end corner of the table, allowing for the game to continue. It should be understood that the vertical drive system 10 and the horizontal drive system 17 are exemplary embodiments of the invention, but various modifications such as the use of a conveyor belt or pulley system may also be used.

Means, responsive to the controlling computer, for extending and/or retracting each of the one or more cups can be motorized mechanical arms, with or without joints, hydraulic cylinders, pneumatic systems similar to those used to dispense lottery balls, wherein the cups have protrusions that prevent ejection, geared motion systems based on worm gears, spur gears, planetary gears, helical gears, herringbone gears, bevel/miter gears, rack-type gears, face gears, chain-sprocket combinations or equivalents thereof or combinations thereof. Drive motors can be permanent magnet stepper motors, variable reluctance stepper motors, hybrid synchronous stepper motors, bipolar motors, AC motors, DC motors or equivalents thereof or combinations thereof. Response to the controlling computer can be mediated by wave drive, full step drive and half step drive pulse sequences or equivalents thereof or combinations thereof. Precision drives can be mediated by micro stepped pulses or equivalents thereof or combinations thereof. Drive circuitry can be L/R type (constant voltage) or chopper type (constant current) or equivalents thereof or combinations thereof. Motor controllers can be variable frequency drives, phase vector drives, direct torque control drives, SCR or thyristor drives, PWM or chopper drives, servo controllers, ripple and transient counting controllers, stepper motor controllers or equivalents thereof or combinations thereof. Connections to the computer can be mediated through Ethernet connections, WiFi connections, USB connections, serial connections, IEEE-488 connections, parallel connections, Bluetooth connections or equivalents thereof or combinations thereof.

Figure 3A:
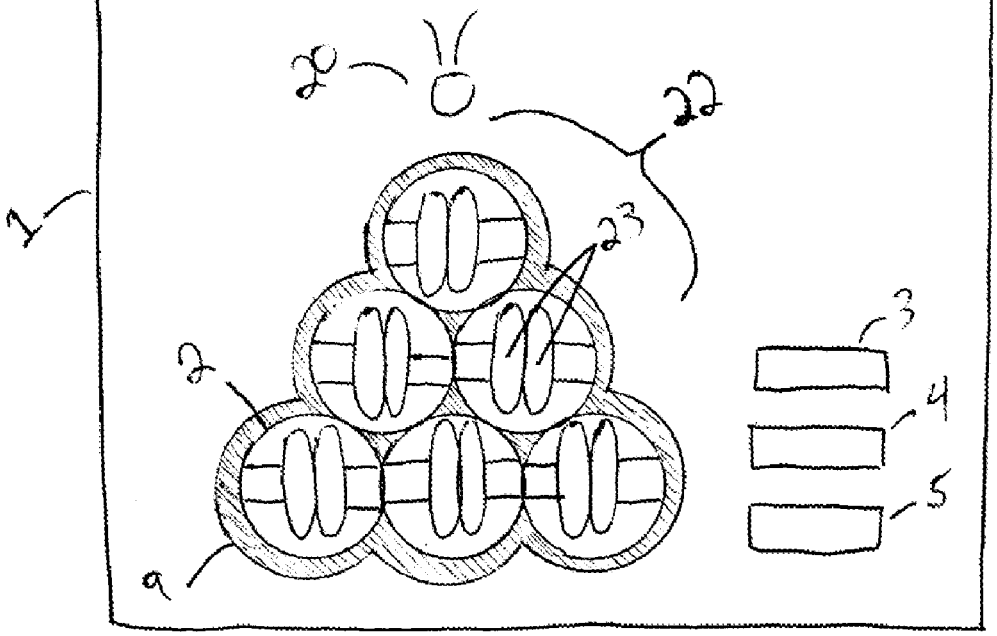
FIG. 3*a* is an overhead view of a sensor system at the bottom of exemplary cups of the invention.

FIG. 3*a* displays an overhead view of the table 1 and the cups 2. Illustrated is the sensor system 22. When a game ball 20 has entered the cup 2, it activates a sensor 23 on its way towards the bottom of the cup 2. This sensor 23 is operably engaged with the CPU 25 (not shown here) with electrical wires and circuits (not shown). The CPU 25 receives signals from sensors 23 and activates the vertical drive system 10 in FIG. 2 and if needed horizontal drive system 17 in FIG. 2. The CPU 25 may also optionally apply signals from the sensors 23 to elicit sound from an optional set of speakers (not shown), activating to table top scoring display of device 8, and the covering drive system 24 in FIG. 3*b* which uses principle functions of the horizontal drive system 17 in FIG. 2.

Figure 3B:
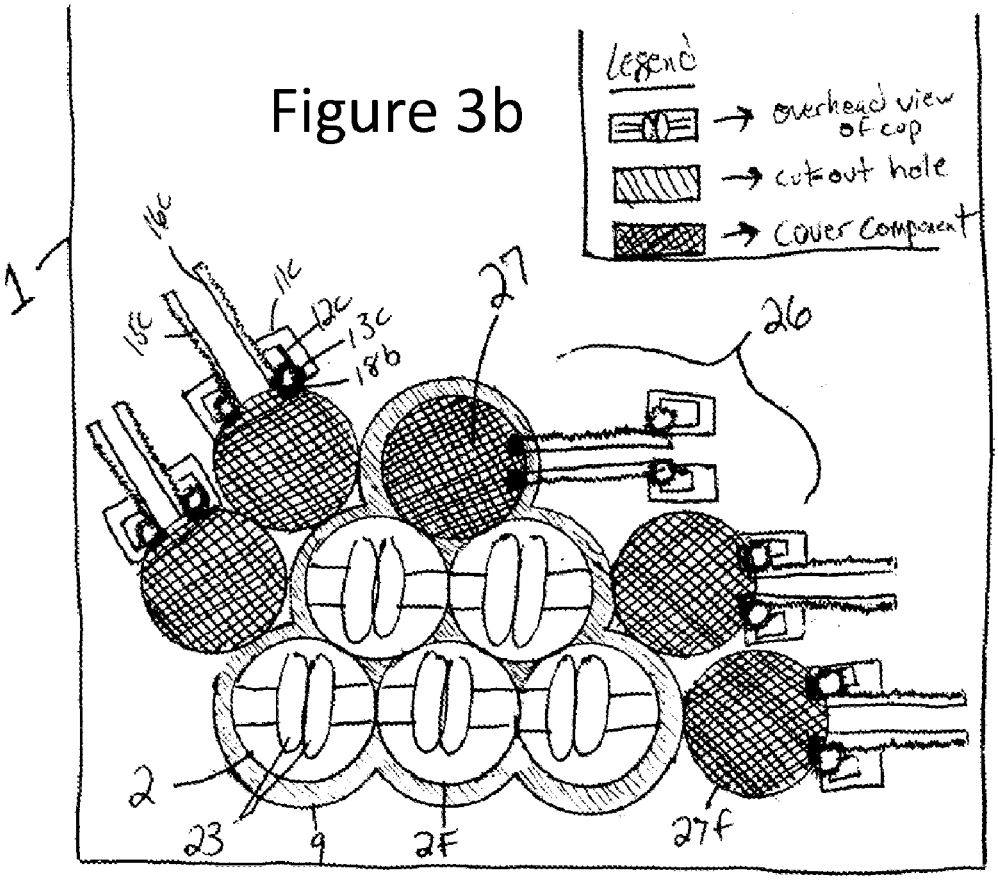
FIG. 3*b* is an overhead partially cut away view of a "covering" drive system of the invention following the entry of a game ball.

The cover system 26 is illustrated in FIG. 3*b*. During game play the game ball 20 triggers the sensor 23 when the ball enters the cup 2 resulting in the previously mentioned actions and communications with the CPU 25. The trigger of the sensor 23 also signals the cover system 26 accomplished from the interior of the table 1. The cover system 26 uses the same mechanisms as the horizontal drive system 17 in FIG. 2. Attached to a housing mechanical base 11*c* a motor 12*c* drives a motor gear 13*c* that in turns rotates another horizontal drive gear 18*b*. The horizontal drive gear 18*b* engages a plurality of teeth 15*c* of the advancing/retracting member 16*c*. This advancing/retracting member is affixed to a cover component 27. When the cover system 26 is enacted the cover component 27 will fill the void of the cup 2. Cover component 27*f* is specially programmed to fill the void of the final cup 2*f* in the event it is the first cup 2 made, otherwise it will cover the cup 2 originally intended that is immediately in its range. The reason for this special exception is that the position of the final cup 2*f* makes it impossible for it to have its own cover 27. If it is not the first cup 2 made then it is irrelevant considering the "Reracking" (see invention's game play below) that takes place throughout the rest of the game. For every other formation the final cup 2*f* will be in its standardized position. As previously mentioned some formations require alternate positions, this is the purpose of the horizontal drive system 17 of the cups 2. The purpose of the cover system 26 is after the cup 2 has been retreated the cut out hole 9 needs to be covered to prevent the game ball 20 from reentry into a cup that had already been entered during the course of that specific game turn. The cover component 27 will be made of similar material as the electronic game table 1. The cover component 27 will be retreated in the same matter for instances when the cup 2 will be protruded back into game play. Other means for covering holes include, for example, trap door systems and sliding cover devices. Means for activating game functions include buttons, sensors and electronic communications. Means, connected to the controlling computer, for actuating one or more game functions can also be mechanical switches, sensors embedded in the table, capable of detecting a ball striking the surface, voice controllers, light sensors, capacitance sensors, motion sensors, proximity sensors or equivalents thereof or combinations thereof. Buttons, interfaced to the controlling computer for actuating game function can be mechanical switches, or virtual switches that comprise sensors similar to those described supra. These sensors can be mediated if necessary by analog to digital logic known in the art, analog triggers, optoelectronic couplers or equivalents thereof or combinations thereof. Connections to the computer can be mediated through Ethernet connections, WiFi connections, USB connections, serial connections, IEEE-488 connections, parallel connections, Bluetooth connections or equivalents thereof or combinations thereof.

Means for detecting a game ball contacting the table include sensors such as, for example, pressure sensors, light sensors such as infrared sensors, capacitance sensors, magnetic sensors, piezoelectric sensors, RFID sensors and equivalents thereof or combinations thereof. In the latter case, using RFID sensors, it is possible to detect which game ball made contact with the table or entered a cup.

As illustrated in FIG. 4, electronic game table 1 has a CPU 25 as its primary processor that is coupled with a memory device 28. The memory device 28 having functions of read only memory (ROM) 29 and random access memory (RAM) 30. The ROM 29 is the electronic game table's 1 hard drive. All the machine's program codes which control how the device operates are stored in the ROM 29. The RAM 30 utilizes and stores data of programs that are in a current or particular use of the CPU 25. The ROM 29 and RAM 30 of the memory device 28 are programmed with the CPU 25 to interpret and execute the commands of the sensors 23 and the input devices 3, 4, and 5. The bill/coin acceptor 6, the side display device 7, table top display device 8, and soundcard/speakers 31 also communicate and are controlled by the CPU 25.

Means, connected to the controlling computer, for covering the holes after a cup is retracted can be of trap-door design, sliding door design, double door design, flexible membrane design, aperture design, covers that rotate into place along an axis, or equivalents thereof or combinations thereof. Actuation of the means for covering the holes can be accomplished by motorized mechanical arms, with or without joints, hydraulic cylinders, pneumatic systems similar to those used to dispense lottery balls, wherein the cups have protrusions that prevent ejection, geared motion systems based on worm gears, spur gears, planetary gears, helical gears, herringbone gears, bevel/miter gears, rack-type gears, face gears, chain-sprocket combinations or equivalents thereof or combinations thereof. Drive motors can be permanent magnet stepper motors, variable reluctance stepper motors, hybrid synchronous stepper motors, bipolar motors, AC motors, DC motors or equivalents thereof or combinations thereof. Response to the controlling computer can be mediated by wave drive, full step drive and half step drive pulse sequences or equivalents thereof or combinations thereof. Precision drives can be mediated by micro stepped pulses or equivalents thereof or combinations thereof. Drive circuitry can be L/R type (constant voltage) or chopper type (constant current) or equivalents thereof or combinations thereof. Motor controllers can be variable frequency drives, phase vector drives, direct torque control drives, SCR or thyristor drives, PWM or chopper drives, servo controllers, ripple and transient counting controllers, stepper motor controllers or equivalents thereof or combinations thereof. Connections to the computer can be mediated through Ethernet connections, wireless modem technology such as WiFi connections, USB connections, FireWire connections, serial connections, IEEE-488 connections, parallel connections, Bluetooth connections or equivalents thereof or combinations thereof.

Means for re-racking cups after one or more made shots are automatic and may be driven by the controlling computer a separate mechanism such as a mechanical drive, or an embedded processor or equivalents thereof or combinations thereof.

The shape taken by the re-racked cups can be predefined or user defined during play. Generally, within these means, re-racking is accomplished using the existing mechanism for extending and retracting the cups.

DESCRIPTION OF THE INVENTION'S GAMEPLAY

It is to be understood that not only can other embodiments and structural changes be made, but alterations of the game play can be made without departing from the scope of the present invention.

The game table may include a bill acceptor wherein players insert money into the acceptor. When players insert money into the game table, the side display device located above the bill acceptor is programmed to acknowledge the credit. The side display device may include other capabilities, including, for example, a touch screen or keypad capabilities which can be programmed for other chosen objectives. Once credit is acknowledged, the side display device displays on screen instructions for the players to follow. The first instruction is for the players to "sign up", which will distinguish their order of game play by a team name. Following "sign up" the display device may do, for example, 1) display rules of game play 2) display "sign up" order 3) display a leader board or high score list, 4) display any combination of 1-3, and or 5) display a user choice page to view what the player chooses to be displayed. After a completed game the next team on the sign up list would begin a new game by hitting the input device labeled "start game". Once the team hits the start button at least 6 cups rise up from machine to pyramidal or other desired geometric position. Variations of rules could be enforced by participating teams. Typically teams take turns taking two shots at the other team's cups. A shot is performed by either throwing a game ball directly toward the cups or other containers, or the game ball may be bounced on the table toward the cups or other containers. Optionally there may be a designated area into which the ball must be bounced and an optional sensor may be attached that indicates if the designated area has in fact been bounced onto by the game ball. If the game ball enters the cup or other container is the sensor attached to the cup would recognize be activated and the cup would retreat (be lowered) inside the table. If both shots are made during the same turn the CPU and memory device (that includes ROM and RAM) would recognize this as a "Rollback". A "Rollback" is when both shots are made during the same turn resulting in that team receiving both balls back, and a continuation of their turn with 2 more shots. If a team does not make both shots then the opposing team would then hit the "our turn" input button. This process is repeated until such time as there is a final cup of the initial set of cups. For the final cup there are different rules. Rule 1: There are no "rollbacks" on 2 consecutive successful shots unless the 2 consecutive successful shots including putting the game balls into the final cup which would be considered an automatic victory (see rule 2). Instead of a "rollback" the opposing teams is given a do or die situation called "Redemption". "Redemption" gives the team one last turn to get to and make the final cup using the previous rules with "Rollbacks". Rule 2: The final cup is the only cup that a team gets a chance to make both balls in. There is no automatic victory on making both balls in a cup that is not the final cup as the first 5 cups (in a six cup game) are retreated immediately below the table. Rule 3: If both teams make the final cup then the game will go into overtime. Overtime will use the same set of rules using 1-3 cups.

The device is programmed to respond to game balls entering a cup or other container, and external inputs made by any of the players. The device responds and stores inputs made by the players. On a shot that both teams agree will not count for whatever circumstance there is a input device button 4 in FIG. 1 which, when pushed, whatever action the device recorded will be voided. If the action is a game ball entering a cup or other container, then pushing the input device button 4 in FIG. 1, the cup would return (advance) to its original position. Any scoring given would also be voided. This is to control, amongst other things, human error or penalty shots. The computer will recognize missed shots when the opposing team hits the "our turn" button. Another responsibility of the device is what is called "Re-racking" "Re-racking" is the repositioning of the cup formation after certain cup(s) have been made. Depending on the particular device's program there could be a number of different formations used. Typically this is done with 4 cups using a diamond formation, 3 cups using a triangular formation, 2 cups in "I" formation, and 1 cup all being centered of original pyramid. Certain programs could call for the device to automatically "Re-rack" at certain formations. Other programs may call for the device to honor just one or two re-racks and make it "player option". This may involve adding an input device button for "Re-racking", or adding functions to an existing input device.

The game table may be rectangular, with the length longer than the side with two teams facing each other. The game table may also be a square with 4 teams at each side and game play may include the throwing or bouncing of the game balls into any of the geometric formations at any of the three other sides. The table may also be hexagonal or any number of configurations which would allow any number of teams, or individual player, from playing and throwing or bouncing of the game balls into any of the geometric formations at any number of sides of the table. As an option, two or more game tables may be placed next to each other in a number of configurations, again to add interest to the variety of the game.

The various embodiments of the present invention may achieve a number of advantages over previous electronic and non-electronic game tables, including, for example; 1) the invention is computerized and controlled electronically providing players with a new, exciting gaming experience; 2) provides a way for the game to be played without the requirement of drinking (the game is normally played resulting in consuming alcohol). The following advantages are a result from eliminating the drinking aspect of the game: 2a) the game can be enjoyed from a non-alcohol point of view including those under 21. 2b) Eliminates some of the health concerns created from original game play: Spread of disease, colds by way of bacteria gathered by the game ball, and obviously intoxication, binge drinking and alcohol poisoning. 2c) Eliminates the mess factor of spilled drinks, etc. 3) Provides a way for the game to be enjoyed at different venues including bars, bowling alleys, restaurants, arcades, amusement parks, etc. (In many states beer pong is illegal in public places).

The foregoing description has been presented for purpose of illustration. It is not intended to be exhaustive or to limit the invention to the precise form disclosed. Modifications and variations are possible in light of the above teachings. It is intended that the scope of the invention be defined by the claims and their equivalents appended hereto.

What is claimed is:

1. An electronic game table, comprising:

a. a table top;

b. a controlling computer;

c. one or more cup stations attached to a vertical drive system, d. one or more cups at each cup station, wherein each cup comprises a sensor for sensing when a game ball enters the cup, wherein each sensor is connected to the controlling computer and wherein each cup station comprises
   i. means, responsive to the controlling computer, for extending and/or retracting each of the one or more cups, and
   ii. means, connected to the controlling computer, for covering the holes after a cup is retracted, and e. means, connected to the controlling computer, for actuating one or more game functions.

2. The electronic game table of claim 1, further comprising means for accepting payment.

3. The electronic game table of claim 1, wherein the one or more means connected to the controlling computer for actuating game function actuates one or more control functions chosen from starting a game, cancelling actions during game play, activating the cup stations, deactivating the cup stations, sensing a ball striking the table or signaling the end of a turn.

4. The electronic game table of claim 1, further comprising means for returning a ball.

5. The electronic game table of claim 1, further comprising a console that displays the state of play.

6. The electronic game table of claim 1, wherein the table comprises from 2-6 cup stations.

7. The electronic game table of claim 1, wherein the game table may further comprise a circular, square, rectangular, hexagonal or other geometric shape each with 2 or more cup stations capable of allowing 2 or more players or teams to participate in the game.

8. The electronic game table of claim 1, wherein the means, connected to the controlling computer, for actuating one or more game functions comprises a means for detecting a game ball coming in contact with the table, optionally, within a designated boundary.

9. The electronic game table of claim 1, further comprising means for automatically re-racking the cups during play.

10. An electronic game table comprising:

a. a table top;

b. a controlling computer;

c. one or more cup stations, wherein each cup station comprises one or more cups, wherein each cup station comprises a sensor for each cup for sensing when a game ball enters the cup, wherein each sensor is connected to the controlling computer and wherein each mounting base comprises;
   i. a vertical drive system, interfaced to the controlling computer, for extending each of said one or more cups;
   ii. a vertical drive system, interfaced to the controlling computer and responsive to a made shot, for retracting each of said one or more cups;
   iii. a mechanically operated cover, interfaced to the controlling computer, for covering the holes after a cup is retracted; and d. one or more buttons interfaced to the controlling computer for actuating game function,
   wherein the vertical drive systems for extending each of said one or more cups and for retracting each of said one or more cups can be the same or different and comprise a drive motor and gear drive combination, or a pneumatic drive.

11. The electronic game table of claim 10, further comprising means for accepting payment.

12. The electronic game table of claim 10, wherein the one or more buttons interfaced to the controlling computer for actuating game function actuate one or more control functions chosen from starting a game, cancelling actions during game play, activating the cup stations, deactivating the cup stations and signaling the end of a turn.

13. The electronic game table of claim 10, further comprising means for returning a ball.

14. The electronic game table of claim 10, further comprising a console that displays the state of play.

15. The electronic game table of claim 10, wherein the table comprises from 2-6 cup stations, wherein each cup station comprises one or more cups.

16. The electronic game table of claim 10, wherein the game table may further comprise a circular, square, rectangular, hexagonal or other geometric shape each with 2 or more cup stations capable of allowing 2 or more players or teams to participate in the game.

17. The electronic game table of claim 10, further comprising a means for detecting a game ball coming in contact with the table, optionally, within a designated boundary.

18. The electronic game table of claim 10, further comprising means for automatically re-racking the cups during play.

* * * * *